US005509650A

United States Patent [19]

MacDonald

[11] Patent Number: 5,509,650

[45] Date of Patent: Apr. 23, 1996

[54] AUTOMATED PRACTICE TARGET FOR GOAL-ORIENTED SPORTS AND A METHOD OF TRAINING USING THE PRACTICE TARGET

[76] Inventor: Lee MacDonald, 106 Manion Rd., Carp, Ontario, Canada, K0A 1L0

[21] Appl. No.: 323,029

[22] Filed: Oct. 14, 1994

[51] Int. Cl.[6] ..... A63B 69/40

[52] U.S. Cl. ..... 273/26 R; 273/127 R; 273/127 A

[58] Field of Search ..... 273/354, 126 R, 273/26 R, 26 A, 29 R, 29 A, 181 R

[56] References Cited

U.S. PATENT DOCUMENTS

| | | | |
|---|---|---|---|
| 3,765,675 | 10/1973 | DiMarzio | 273/354 |
| 3,887,181 | 6/1975 | Samaras | 273/354 |
| 4,995,607 | 2/1991 | Whitfield | 273/354 |

FOREIGN PATENT DOCUMENTS

| | | |
|---|---|---|
| 976577 | 10/1975 | Canada . |
| 1204460 | 5/1986 | Canada . |
| 1206496 | 6/1986 | Canada . |
| 2019338 | 12/1991 | Canada . |

*Primary Examiner*—Vincent Millin
*Assistant Examiner*—Charles W. Anderson
*Attorney, Agent, or Firm*—Hardaway Law Firm

[57] ABSTRACT

An apparatus and method for improving the scoring skills of a player practicing a sport, such as hockey, ringette, broomball, soccer and lacrosse, involving propelling a playing piece into a goal tended by a goalkeeper is disclosed. A target support is sized to approximate the goal and at least two targets positioned thereon are representative of areas which are typically unprotected by a goalkeeper in a common goal guarding position. A sensor detects a player in a predetermined area proximate the target support and generates a signal to a processor which executes a program to indicate at least one of the targets as a current target for which the player should aim. The current target indicator is activated for a predetermined period of time, for example dependent on the skill of the player, or until the playing piece successfully strikes the current target. The processor preferably accumulates statistics useful in gaging the skill progression of the practicing player.

26 Claims, 5 Drawing Sheets

AUTOMATED PRACTICE TARGET FOR GOAL-ORIENTED SPORTS AND A METHOD OF TRAINING USING THE PRACTICE TARGET

FIELD OF THE INVENTION

The present invention relates to an apparatus for improving the scoring skills of a player practicing a sport involving propelling a playing piece into a goal tended by a goalkeeper and, in particular, to an automated apparatus for improving the player's skills.

BACKGROUND OF THE INVENTION

There has been a long standing recognition that in sports which involve scoring by propelling a playing piece into a goal tended by a goalkeeper, goal scoring practice can make a valuable contribution to a player's skill at the game. The problem associated with practicing with a goalkeeper is that a team of several players typically includes only one or two goalkeepers. Individual practice in goal scoring therefore puts an inordinately heavy demand on the goalkeeper. Attention has therefore been directed to developing apparatus and methods for permitting individuals to practice goal scoring without a goalkeeper by simulating goaltending with one means or another.

One such apparatus is taught in Canadian Patent Application Number 976,577 which issued on Oct. 21, 1975 to Frantti. This patent teaches a planar impact-resistant panel which is sized to fit the front of a regulation hockey goal. The panel includes seven rectangular slots positioned to imitate parts of the goal mouth not readily covered by a goalkeeper in a crouched position at the center of the goal. The front of the panel is decorated with a picture of a goalkeeper in the crouched position.

Canadian Patent Application Number 2,019,338 to Roy was published on Dec. 20, 1991. This application describes a thin, flexible impact-resistant panel which is attached to the front of a regulation hockey goal using elastic straps. The panel includes ten openings positioned to indicate areas of the goal mouth that cannot be covered by a goalkeeper in a crouched position.

The principal disadvantages of the inventions taught by Frantti and Roy are that they provide static target areas, make it difficult to retrieve a hockey puck after a successful scoring attempt and fail to provide the player with any indication of his progress in improving his skills. Furthermore, the devices are not capable of testing a player's reflexes and, in particular, the accuracy of a scoring attempt made while acting on reflex. It will be appreciated by those skilled in the art that, in a game situation, a potential target within a goal changes as the goalkeeper moves to one area of the goal, thereby exposing a new unprotected area of the goal. Thus a potential target may be available only for a short period of time.

Canadian Patent Numbers 1,204,460 and 1,204,496 issued to Daoust on May 13, 1986 and Jun. 24, 1986, respectively. Each patent discloses a hockey goal-shaped target area comprising upright posts and a horizontal bar sized to conform to the mouth of a regulation hockey goal. Attached to the posts and/or the bar are targets preferably positioned in the four corners of the rectangular opening of the goal mouth. An indicator lamp is associated with each target and the lamps are randomly activated by an electronic controller. The object of a practice session is to shoot a hockey puck at the target indicated by an indicator lamp.

Striking a target while an indicator lamp is lit elicits an audible response to reward the player.

The apparatus taught by Daoust likewise has several disadvantages. First it provides a completely open target area shaped to simulate a hockey goal. A shot within the goal mouth, even though it misses a target, tends to unduly reinforce the practicing player. Furthermore, the practice session is substantially unstructured. The indicator lamps are lit in a random pattern and remain lit for an adjustable period of time. Once an indicator controller is turned on, it appears that it switches on the target indicator lamps in a random pattern until the controller is turned off, regardless of the position or success of the practicing player or the duration of the practice session. Another disadvantage of the Daoust apparatus is that the lamps which indicate a respective target are distanced from the target itself. Accordingly, if further targets are added to the apparatus, it could be difficult for a player to quickly determine which target is associated with a particular lamp. Finally, there is no provision for measuring a player's success or improvement in his scoring skills because there is no means for counting shots or accumulating statistics relating to the attempted versus successful shots at the target.

SUMMARY OF THE INVENTION

It is an object of the invention to overcome the shortcomings of the prior art.

It is a further object of the invention to provide an apparatus for improving the scoring skills of a player practicing a game involving propelling a playing piece into a goal tended by a goalkeeper which ensures a structured practice session designed to progressively improve the player's skills.

It is another object of the invention to provide such an apparatus which accumulates statistics relating to a player's success at practice so that progress can be monitored and weaknesses can be isolated.

It is yet a further object of the invention to provide a practice apparatus which simulates the actions of a goalkeeper by monitoring the position of the practicing player with respect to the target area and providing targets responsive to the position of the player with respect to the goal.

These and other objects are achieved by providing an apparatus for improving the scoring skills of a player practicing a game involving propelling a playing piece into a goal tended by a goalkeeper, comprising a target support for supporting at least two targets for the playing piece propelled by the player; an indicator associated with each target for indicating at least one of the targets as a current target for the playing piece; a processor for controlling the indicators to automatically indicate at least one of the targets as the current target in accordance with predetermined variables; and sensor means for detecting the player in a predetermined area proximate the target support, the processor being responsive to a signal from the sensor means representative of at least an initial detection of the player in the predetermined area as a one of the predetermined variables.

The invention therefore provides a target support for supporting at least two targets for a playing piece propelled by a practicing player. The target support is dimensioned to simulate the mouth of a goal for the sport to be practiced. The invention may be used to practice any sport which involves propelling a playing piece into a goal. Hockey, ringette, broomball, soccer and lacrosse are a few of the sports particularly adapted to benefit from the invention. The targets may be of any appropriate shape and size. They are placed in areas that correspond to areas of a goal that are difficult for a goalkeeper to protect. An indicator is associated with each target to indicate the target which is to be struck with the playing piece. The indicator is preferably a light source positioned behind a transparent or translucent target. A processor controls the indicators to automatically indicate a target as a current target in accordance with predetermined variables.

In order to ensure a structured practice session, the apparatus is provided with a sensor for detecting a player in a predetermined area proximate the target support. To initiate a practice scoring attempt, the player enters the predetermined area proximate the target. The detection of the player triggers the processor to indicate at least one of the targets as a current target. Once selected, the current target indicator remains activated for a predetermined, programmable length of time. If the player successfully strikes the current target within that time, the player is rewarded with an audible response and a successful scoring attempt is recorded. If the player fails to strike the current target within the predetermined time, the apparatus is reset and an unsuccessful attempt is recorded. Preferably, the position of the target is also recorded in association with each success or failure. Thus, valuable statistics are provided for isolating the areas where a player requires most practice.

In a more sophisticated embodiment of the invention, the apparatus is provided with two or more sensors to determine the relative position of the player with respect to the target support and to simulate the movements of a goalkeeper by indicating targets which represent areas of the goal which are typically unprotected by a goalkeeper when the player is in a given position with respect to the target support. In this mode, one or more targets are dynamically indicated as the player changes position and the practice attempt is of a preselected time duration which starts when the player enters the predetermined area and ends with a successful strike against an indicated target or upon expiry of the preselected time.

BRIEF DESCRIPTION OF THE DRAWINGS

The invention will now be explained by way of example only and with reference to the accompanying drawings which illustrate a preferred embodiment of the invention, wherein.

DETAILED DESCRIPTION OF A PREFERRED EMBODIMENT

The apparatus in accordance with the present invention allows a player to strengthen his skills, namely accuracy and reflex, in sports which involve, at least to some degree, accurate aim of a projectile, for example a puck or ball, into a goal tended by a goalkeeper. The apparatus also enables a player to review his practice session by accumulating statistics about the session. The statistics may be a simple accumulation of scores/misses or a more detailed accumulation by target.

The drawings and the description which follow describe the use of an apparatus in accordance with the present invention for practicing hockey scoring skills. However, it is to be understood that the invention can be readily adapted to any goal-oriented sport, such as ringette, broomball, soccer or lacrosse, for example.

Figure 1:
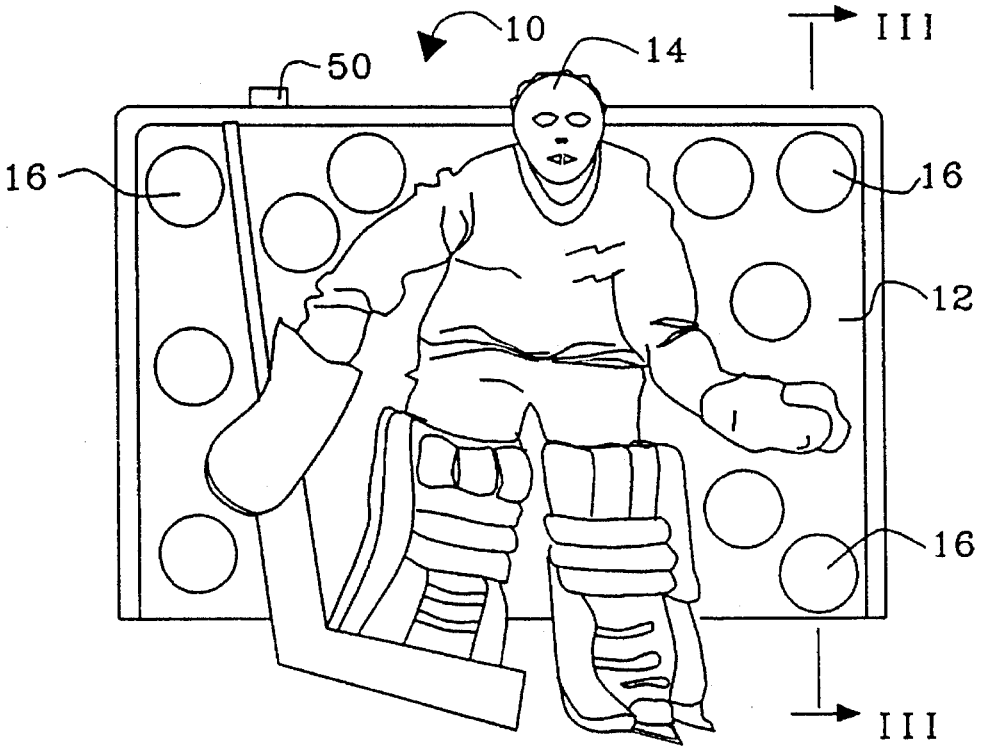
FIG. 1 is a front elevational view of an embodiment of an apparatus in accordance with the invention for improving the skills of a hockey player.

FIG. 1 shows a front elevational view of a practice apparatus, generally referred to by the reference 10, for assisting hockey players in improving their goal scoring skills. The practice apparatus 10 preferably includes a front panel 12 which serves as a target support. The front panel 12 is preferably sized in conformance with the size of a regulation hockey goal. It is also preferably decorated to provide a simulated view of the front of a goal. The decoration preferably includes a simulated goalie 14 which may be a pictorial representation of a goalie or, alternatively, a molded figure attached to the front panel 12 to provide a three-dimensional effect for improving the realism of a practice session.

The front panel is provided with a number of targets 16 which are adapted to detect the impact of a hockey puck within the target. In a preferred embodiment of the apparatus, each target 16 includes a hole formed in the front panel 12, as will be explained in more detail below. The targets 16 shown in FIG. 1 are circular shapes, though the shape is arbitrary. The targets may be of any desirable shape and are preferably positioned to simulate areas which cannot be protected by a goalie in a crouched position in the center of a net. Those skilled in the art will understand that each target must be of a certain practical size to make practice meaningful, the size depending at least in part on the sport for which the target is designed.

Figure 2:
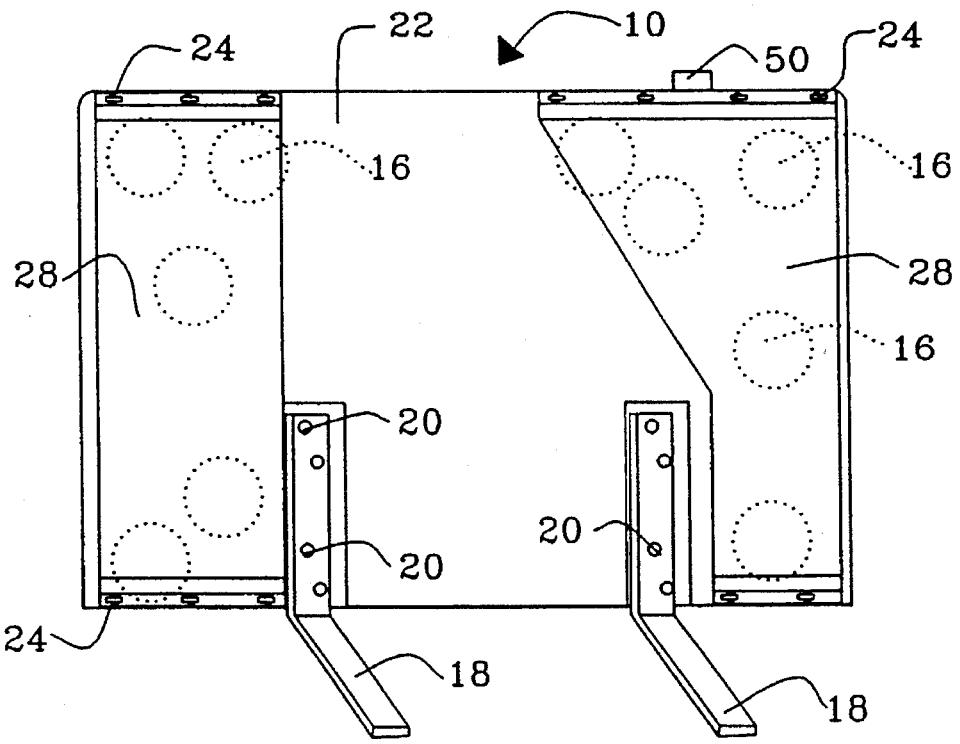
FIG. 2 is a rear elevational view of the apparatus shown in FIG. 1.

FIG. 2 shows a rear elevational view of the practice apparatus 10. The practice apparatus is preferably a free-standing apparatus supported by support legs 18 which may be steel bar stock to lend weight and provide stable support for the front panel 12. The support legs are preferably provided with cleats (not illustrated) to ensure that the practice apparatus 10 will not slide across an ice surface when impacted by an ice hockey puck. The support legs 18 are attached to the front panel 12 using bolts 20 or the like.

Figure 3A:
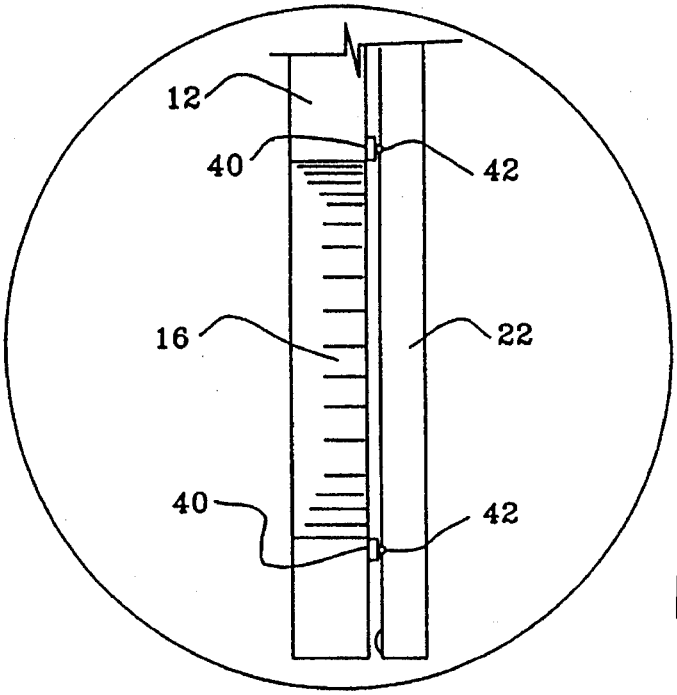
FIG. 3 is a cross-sectional view taken along line III—III shown in FIG. 1.
Figure 3B:
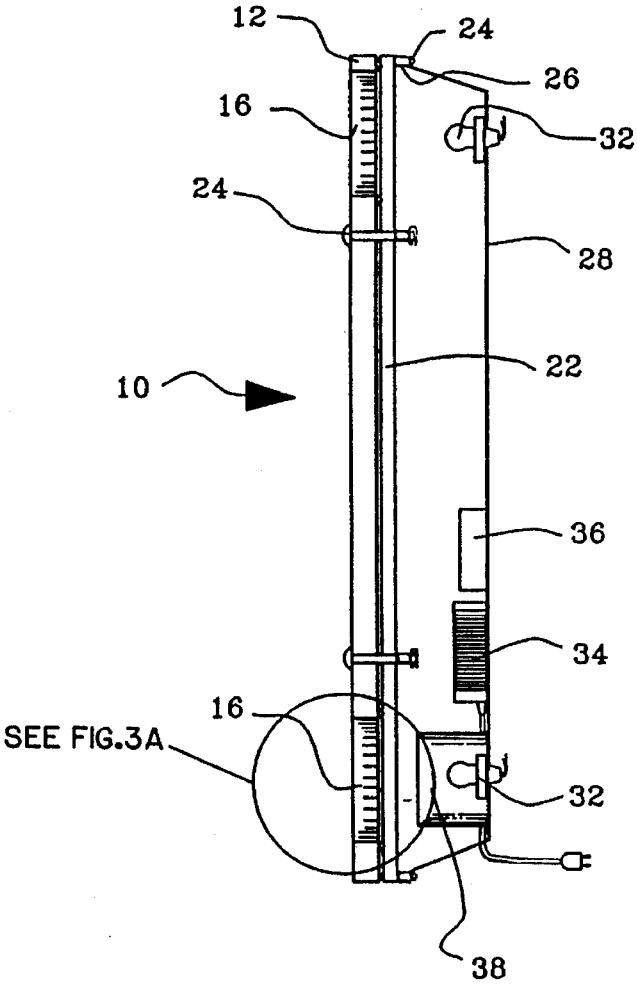

Attached to the rear of the front panel 12 is an indicator panel 22 which is displacably mounted to the front panel using swivel quick pins 24 and compression coil springs 26 (see FIG. 3). The swivel quick pins 26 are commercially available from the Swivel Quick Corp. and described in U.S. Pat. No. 4,822,197. The indicator panel 22 is preferably a resilient, transparent or translucent plastic material such as LEXAN, readily commercially available. The indicator panel 22 covers each of the targets 16, indicated in dotted lines in FIG. 2. Mounted to the indicator panel are mounting brackets 28 which support the electronic components of the apparatus 10 as will be explained in relation to FIGS. 3 and 4. The mounting brackets 28 may be of any convenient shape.

FIG. 3 shows a cross-sectional view of the practice apparatus 10 taken along lines III—III of FIG. 1. As explained above, the indicator panel 22 is mounted to a rear surface of the front panel 12 using quick swivel pins 24 and compression springs 26 so that the indicator panel 22 is displaceable with relation to the front panel 12 for reasons that will be explained in detail below. The mounting brackets 28 are also mounted to the rear panel using swivel quick pins 24 and compression springs 26. The compression springs 26 are positioned between the indicator panel 22 and the mounting bracket 28 to serve as shock absorbers for protecting the electronic components of the apparatus mounted on the mounting brackets 28 from the impact of practice shots striking the front panel 12 or the indicator panel 22. The electronic components mounted on the mounting brackets 28 include indicator lamps 32, a power supply 34 and a controller 36. The indicator lamps 32 are preferably low voltage light units which provide bright illumination. The lamps may be provided with a reflector 38 which surrounds the lamp and focuses the lamp on the target 16 directly in front of the lamp.

In order to reinforce a player practicing with the apparatus 10, some means must be provided for detecting a successful practice shot. As will be explained below, the controller 36 indicates a practice target by turning on an indicator lamp 32 behind one of the targets 16. If a player successfully strikes the target 16 indicated by the indicator lamp 32 with a hockey puck, the puck strikes a front surface of the indicator panel 22. The momentum of the puck flexes the indicator panel 22 against the bias of an adjacent spring 26 to move the indicator panel 22 away from the front panel 12 for a brief period of time. This movement may be detected electronically. In accordance with the preferred embodiment of the invention, the detection system includes a conductive strip 40 which surrounds the target hole in the front panel 12 for each target 16 and a ground conductor 42 which is attached to the front surface of the indicator panel 22.

Figure 4:
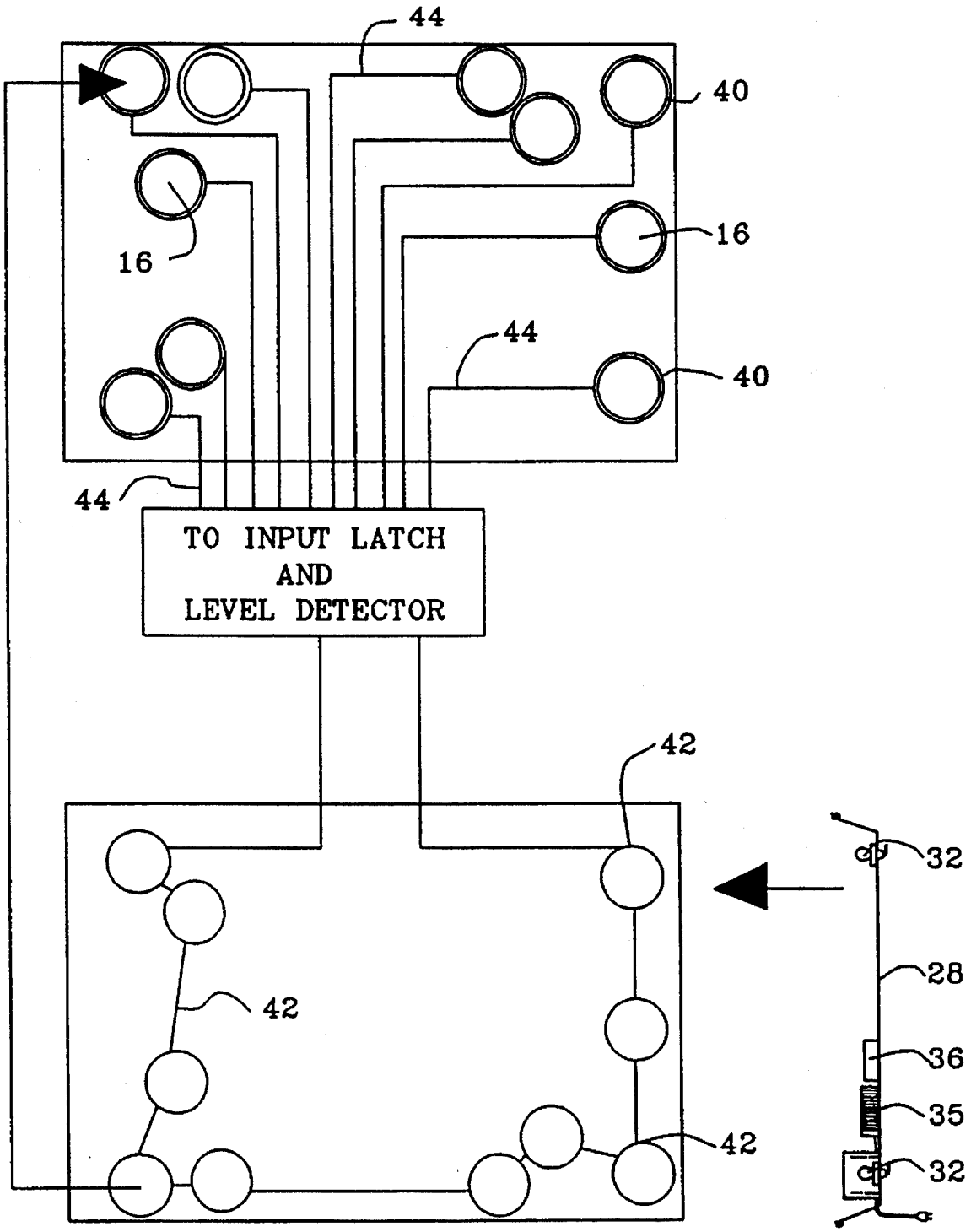
FIG. 4 is an exploded view of the apparatus of FIG. 1.

FIG. 4 shows an exploded view of the apparatus shown in FIGS. 1–3, illustrating a detailed view of the circuit for detecting a shot which strikes a target 16 of the practice apparatus 10. As explained above, the conductive strip 40 preferably surrounds a rear side of each of the targets 16 in the front panel 12. Each conductive strip 40 is connected by an electric conductor 44 to an input latch and level detector 46 (see FIG. 5) which detects strikes on a target 16, as will be described below. Attached to the indicator panel 22 is a ground conductor 42 which is preferably arranged in interconnected circular patterns which overlie the respective conductive strips 40 when the indicator panel 22 is mounted to the front panel 12. The ground connector 42 is connected to a ground pole on the input latch and level detector 46.

Figure 5:
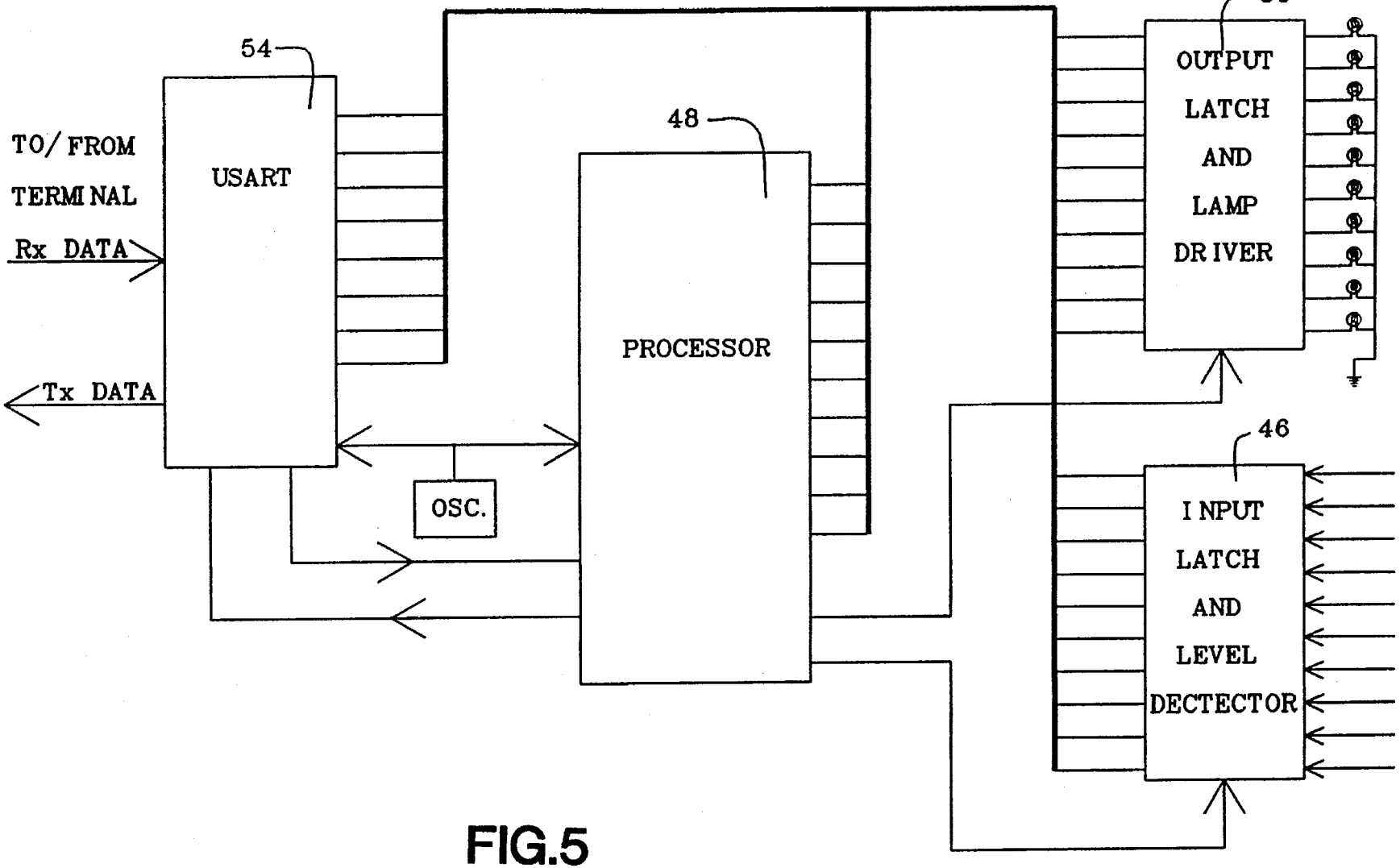
FIG. 5 is a schematic diagram of an embodiment of a control system for the invention.

FIG. 5 shows a schematic diagram of the controller for the practice apparatus 10. The controller includes a processor 48 which operates a program of instructions to control the operation of the practice apparatus 10. In accordance with the preferred embodiment, the apparatus 10 includes a motion sensor 50 (see FIGS. 1 and 2) for detecting the presence of a practicing player in front of the apparatus. The motion sensor is used to lend structure to a practice session so that the session is of maximum benefit to the practicing player and meaningful statistics can be accumulated regarding the ability of the player. The motion sensor may be of a type commercially available under the trade-mark SENTROL Sharp Shooter 6071 series motion detector, with a six degree angle at 90 feet. An output signal of the motion detector is connected to input latch and level detector 46 (see FIG. 5) of the control circuit. When the processor detects a signal from the motion sensor, it executes a program to select a number representing an indicator lamp 32 (see FIG. 3) to indicate a current target 16 for the player. In accordance with a simplest embodiment of the invention, the number representing the indicator lamp 32 for the current target 16 is selected by generating a random number between 1 and n where n equals the number of targets 16. Alter the number has been selected, the processor 48 addresses an output lamp and latch driver 52 which includes octal latches and octal power drivers. The processor 48 turns on an indicator lamp 32 by writing to the appropriate output latch. The input from the processor to the latch is transferred as output to an integrated circuit which serves as an octal power driver to provide the necessary current and voltage (28 VDC) to the selected indicator lamp(s) 32. More than one indicator lamp 32 may be lit at any one time. Alternatively, several lamps may be flashed in succession before one or more indicator lamps 32 indicate a target. The flashing of the indicator lamps 32 is accomplished in the same way by writing to the octal latches with on and off states in succession, in a manner well known in the art.

As noted above, the electric conductors 44 attached to the conductive strips 40 which surround a rear perimeter of each target 16 in the front panel 12 are connected to a normally open switch in the input latch and level detector 46. The input of each switch is held high through a connection to a +5 volt resistive voltage divider. If a practicing player successfully strikes a target 16, the indicator panel 22 temporarily rebounds away from the front panel 12 to separate the contacts between the conductive strip 40 and the ground conductor 42 for that target 16. Breaking the contact de-energizes the relay at the switch, which closes the switch and causes a connection to ground. When a switch is closed, the ground is applied to the corresponding input. The input latch and level detector 46 is a stroked latch with tri-state outputs. When the switches are not being scanned, their outputs are in high impedance mode, effectively disconnecting them from the bus. When the controller 48 scans the switches, it scans for a negative going pulse on any one of the switch inputs. The negative going pulse indicates a strike on a target 16. The identification number of the switch inputting a negative going pulse is compared with the number representing the current target(s) 16. If the identification number of the target struck matches a number representing the current target(s) 16, a successful scoring attempt is recorded.

It is preferable to reinforce a successful scoring attempt with an audible response. To accomplish this, the processor 48 can be programmed to generate an output signal to a sound card and a speaker (not illustrated) which output sound to simulate a cheering crowd, or the like, in a manner well known in the art. If the identification number of the target struck does not correspond to a number representing the current target(s) 16, an unsuccessful attempt is recorded. If a negative going pulse on the input switch is not detected within a specific period of time after a practice sequence is initiated by the detection of a signal from the motion sensor 50, an unsuccessful attempt is also recorded. It is preferable to provide adequate memory associated with the processor 48 to record the identification number of the target along with each record of a successful or unsuccessful attempt.

Data collected in the memory of the processor 48 is downloaded to a terminal and/or a computer using a USART 54 (Universal Synchronous/Asynchronous Receiver/Transmitter for Communication Control) in a manner well known in the art. This permits statistical files to be kept for individuals over extended periods of time, permitting training success and individual progress to be monitored. Furthermore, if a target number is stored with each practice attempt, areas of individual strength and weakness can also be isolated and the program for selecting a target can include a weight factor for selecting targets where the player is weakest at a ratio which is higher than random. Thus, the apparatus may be used as a versatile training tool for honing the skills of individual players based on their particular needs as well as for monitoring the progress of individual players over extended periods of time.

Figure 6:
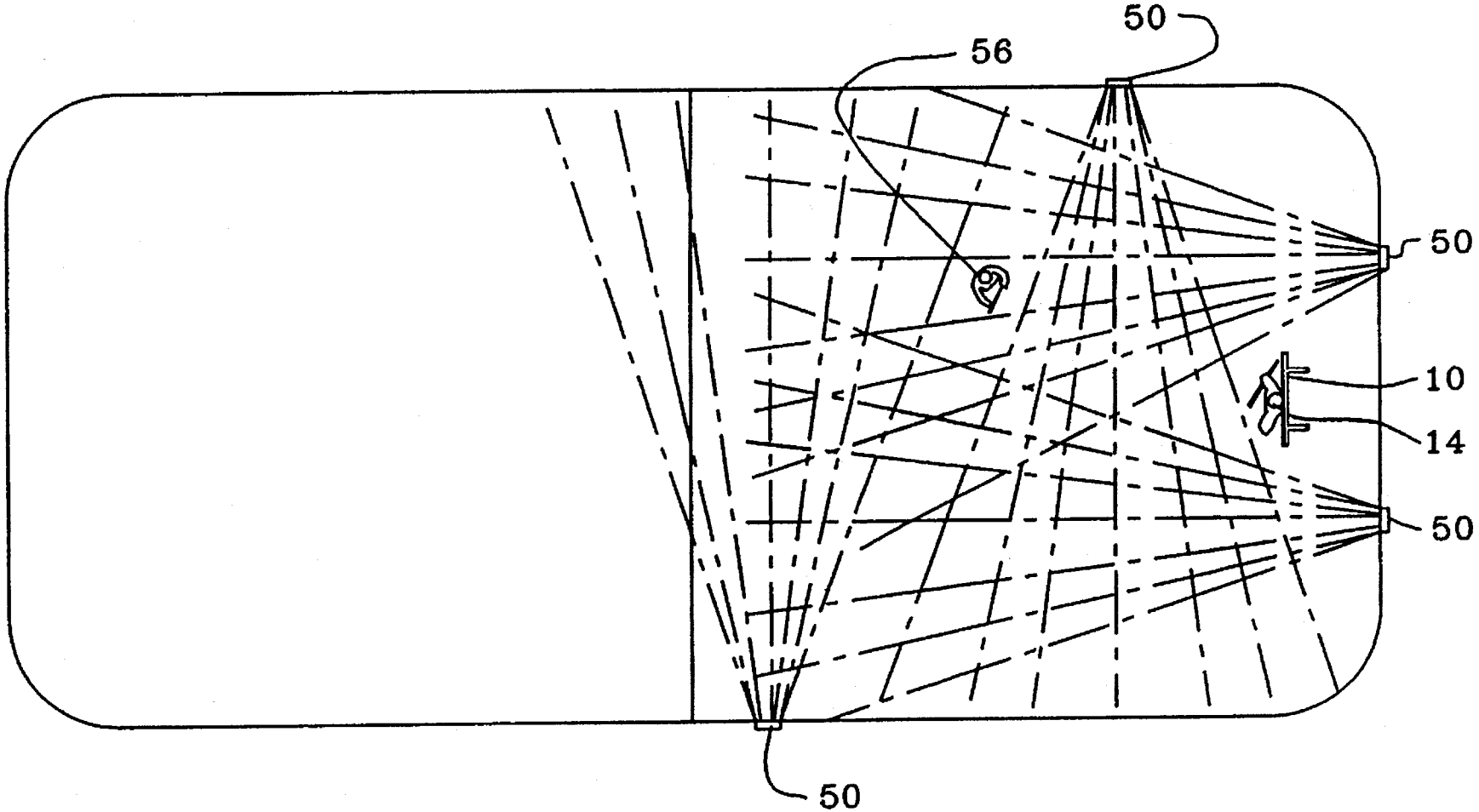
FIG. 6 is a top plan view of another embodiment of an apparatus in accordance with the invention for improving the skills of a hockey player.

FIG. 6 shows an alternate embodiment of the invention installed to provide an even more realistic practice session for a player using the apparatus in accordance with the invention. In this embodiment of the invention, a plurality of motion sensors 50, or some other type of detector capable of monitoring the position of a player, are positioned around the apparatus 10 in order to determine with some measure of accuracy the position of a player 56 with respect to the front panel of the practice apparatus 10. The output of each motion sensor 50 is attached to an input latch on input latch and level detector 46. A program of instructions which executes on the processor 48 is capable of computing the relative position of the player 56 with respect to the front of the practice apparatus 10 by monitoring the output signals of the motion sensors. In this way, the processor 48 is able to select an indicator lamp 32 based on an algorithm intended to imitate the motions of a goalie responding to the position of a player 56. In accordance with this embodiment, a practice session begins when the player enters the monitored area and ends when a target 16 is struck or a predetermined time period has elapsed. The indicator lamps 32, however, are dynamically lit depending on the position of the player 56 with respect to the practice apparatus 10. This provides a sophisticated practice apparatus which simulates a practice session with a goalie.

The apparatus 10 may optimally also include strain gauges (not illustrated) for measuring the force of pucks striking the indicator panel 22, and/or a radar gun (not illustrated) for measuring the speed of pucks shot at the apparatus. The control and operation of such instruments is well understood and therefore not described.

Thus, a novel practice apparatus which may be adapted to be used for any sport having an object of propelling a playing piece into a goal is provided. While the apparatus has been described with reference to a specific embodiment, the disclosure is not intended to be limited to the embodiment described. The scope of the invention is intended to be limited solely by the scope of the claims appended hereto.

The embodiments of the invention in which an exclusive property or privilege is claimed are defined as follows:

1. An apparatus for improving the scoring skills of a player practicing a game involving propelling a playing piece into a goal tended by a goalkeeper, comprising:

a target support for supporting at least two targets for the playing piece propelled by the player;

an indicator associated with each target for indicating at least one of the targets as a current target for the playing piece;

a processor for controlling the indicators to automatically indicate at least one of the targets as the current target; and sensor means for detecting the player in a predetermined area proximate the target support, the processor being responsive to a signal from the sensor means representative of at least an initial detection of the player in the predetermined area as a signal to initiate control of the indicators to indicate one of the targets as the current target.

2. An apparatus for improving the scoring skills of a player practicing a game involving propelling a playing piece into a goal tended by a goalkeeper as claimed in claim 1, further comprising strike sensing means for sensing a strike against the current target.

3. An apparatus for improving the scoring skills of a player practicing a game involving propelling a playing piece into a goal tended by a goalkeeper as claimed in claim 2, further comprising means for indicating when the playing piece strikes the current target.

4. An apparatus for improving the scoring skills of a player practicing a game involving propelling a playing piece into a goal tended by a goalkeeper as claimed in claim 3, wherein the means for indicating is an audible signal.

5. An apparatus for improving the scoring skills of a player practicing a game involving propelling a playing piece into a goal tended by a goalkeeper as claimed in claim 4, wherein the audible signal simulates a cheering crowd.

6. An apparatus for improving the scoring skills of a player practicing a game involving propelling a playing piece into a goal tended by a goalkeeper as claimed in claim 1, wherein the target support is shaped and sized to correspond to the dimensions of the front of the goal and the targets are shaped and sized to correspond to areas of the goal which cannot be covered by a goalkeeper in a typical position for tending the goal.

7. An apparatus for improving the scoring skills of a player practicing a game involving propelling a playing piece into a goal tended by a goalkeeper as claimed in claim 6, wherein the target support is a solid support having a length and a height which corresponds to the regulation dimensions of the goal, and the targets are selected areas positioned within the solid surface so that failed attempts by the player to propel the playing piece onto the current target result in the playing piece rebounding away from the target support.

8. An apparatus for improving the scoring skills of a player practicing a game involving propelling a playing piece into a goal tended by a goalkeeper as claimed in claim 1 or 2, wherein the indicator comprises at least one light source associated with each target.

9. An apparatus for improving the scoring skills of a player practicing a game involving propelling a playing piece into a goal tended by a goalkeeper as claimed in claim 1, wherein the sensor means is a motion sensor.

10. An apparatus for improving the scoring skills of a player practicing a game involving propelling a playing piece into a goal tended by a goalkeeper as claimed in claim 9, wherein the apparatus comprises a plurality of motion sensors for detecting movement of the player relative to the target support and each motion sensor generates a signal which is representative of a position of the player with respect to the target support, the position of the player being used as at least one variable to control the indicators for indicating the current target, whereby the processor indicates the current target in a manner which simulates a goalkeeper responding to the position of the player with respect to the target support.

11. An apparatus for improving the scoring skills of a player practicing a game involving propelling a playing piece into a goal tended by a goalkeeper, comprising:

a target support having a length and a height that corresponds to the regulation dimensions of the front of the goal, the target support having a goal-sized front surface for supporting at least two targets for the playing piece propelled by the player;

at least one indicator light associated with each target for indicating at least one of the targets as a current target for the playing piece;

a processing unit for controlling the indicator light to automatically indicate at least one of the targets as the current target by randomly generating numbers respectively indicative of the targets; and at least one sensor for detecting the player in a predetermined area in front of the target support, the processing unit being responsive to a signal from the sensor representative of at least an initial detection of the player by the sensor in the predetermined area as a signal to initiate randomly generating at least one number to indicate the current target.

12. An apparatus for improving the scoring skills of a player practicing a game involving propelling a playing piece into a goal tended by a goalkeeper as claimed in claim 11, further comprising strike sensing means for sensing a strike against the current target.

13. An apparatus for improving the scoring skills of a player practicing a game involving propelling a playing piece into a goal tended by a goalkeeper as claimed in claim 11, further comprising means for indicating when the playing piece strikes the current target.

14. An apparatus for improving the scoring skills of a player practicing a game involving propelling a playing piece into a goal tended by a goalkeeper as claimed in claim 13, wherein the means for indicating is an audible signal.

15. An apparatus for improving the scoring skills of a player practicing a game involving propelling a playing piece into a goal tended by a goalkeeper as claimed in claim 14, wherein the audible signal simulates a cheering crowd.

16. An apparatus for improving the scoring skills of a player practicing a game involving propelling a playing piece into a goal tended by a goalkeeper as claimed in claim 11, wherein the sensor means is a motion sensor.

17. An apparatus for improving the scoring skills of a player practicing a game involving propelling a playing piece into a goal tended by a goalkeeper as claimed in claim 16, wherein the apparatus comprises a plurality of motion sensors for detecting movement of the player relative to the target support and each motion sensor may generate a signal, which signals in combination are representative of a position of the player with respect to the target support, the position of the player being used to control the indicators for indicating the current target, whereby the processor indicates the current target in a manner which simulates a goalkeeper responding to the position of the player with respect to the target support.

18. An apparatus for improving the scoring skills of a hockey player, comprising:

a target support having a front surface, the front surface having the shape of a hockey goal and including at least two targets for a playing piece propelled by the hockey player;

an indicator associated with each target for indicating to the hockey player at least one of the targets as a current target for the playing piece;

a processor for controlling the indicators to automatically indicate at least one of the targets as the current target; and a sensor for detecting the hockey player in a predetermined area proximate the front surface of the target support, the processor being responsive to a signal from the sensor representative of at least an initial detection of the hockey player in the predetermined area as a signal to initiate control of the indicators to indicate one of the targets as the current target.

19. The apparatus for improving the scoring skills of a hockey player as claimed in claim 18 wherein the front surface of the target support has a height and a width which conforms to the regulation dimensions of an official hockey goal.

20. An apparatus for improving the scoring skills of a hockey player as claimed in claim 18 wherein the indicator associated with each target is a lamp that produces visible light.

21. An apparatus for improving the scoring skills of a hockey player as claimed in claim 20 wherein the targets are provided with a circuit connected to the controller for detecting when a playing piece strikes the target indicated as the current target.

22. An apparatus for improving the scoring skills of a hockey player as claimed in claim 21 wherein the apparatus further includes means for producing an audible reinforcement signal when a playing piece strikes the target indicated as the current target.

23. An apparatus for improving the scoring skills of a hockey player as claimed in claim 21 wherein a successful attempt is recorded in a memory associated with the processor when the circuit detects that the playing piece strikes the current target, and an unsuccessful attempt is recorded if the current target is not struck within a specific period of time after the initial detection of the hockey player.

24. An apparatus for improving the scoring skills of a hockey player as claimed in claim 23 wherein the processor also records in the memory a record of the identification number of each target indicated as a current target along with each record of a successful or an unsuccessful attempt recorded in the memory.

25. The apparatus for improving the scoring skills of a hockey player as claimed in claim 24 wherein the processor is further provided with a communications controller that permits the records recorded in the memory to be downloaded to a computer to facilitate an accumulation of statistical files for monitoring the individual training progress of the hockey player.

26. An apparatus for improving the scoring skills of a hockey player as claimed in claim 18 wherein the apparatus includes a plurality of sensors for detecting the player in a predetermined area proximate the target support, the processor executing a program of instructions which is capable of computing the relative position of the player with respect to the front surface of the target support by monitoring the output signals of the sensors, whereby the processor selects an indicator to indicate the current target based on an algorithm intended to imitate the motions of a goalie responding to the position of the hockey player with respect to the target support.

* * * * *